United States Patent [19]

Mobley et al.

[11] Patent Number: 4,813,889

[45] Date of Patent: Mar. 21, 1989

[54] ELECTRICAL RECEPTACLE TERMINAL CONNECTOR WITH VISUALLY INSPECTABLE COMPONENTS

[75] Inventors: Dewey F. Mobley, Lake Orion; Janice M. Warren, New Hudson; Robert G. Peterson, Sr., Canton, all of Mich.

[73] Assignee: Interlock Corporation, Westland, Mich.

[21] Appl. No.: 107,681

[22] Filed: Oct. 13, 1987

[51] Int. Cl.[4] ..... H01R 13/40

[52] U.S. Cl. ..... 439/595; 439/594

[58] Field of Search ..... 439/592, 594, 595, 597, 439/598, 744, 748

[56] References Cited

U.S. PATENT DOCUMENTS

| | | | |
|---|---|---|---|
| 4,571,017 | 2/1986 | Fujita | 439/594 |
| 4,630,880 | 12/1986 | Durand | 439/595 |
| 4,713,026 | 12/1987 | Mobley et al. | 439/845 |
| 4,753,612 | 6/1988 | Betsui | 439/595 |

*Primary Examiner*—Gil Weidenfeld
*Assistant Examiner*—Paula Austin Bradley
*Attorney, Agent, or Firm*—Harness, Dickey & Pierce

[57] ABSTRACT

An electrical receptacle terminal connector having visually inspectable components and an easily removable tab receptacle terminal inserted therein. The inserted receptacle terminal is retained by means of a moveable finger formed in the sidewall of the receptacle connector cavity which engages the female receptacle terminal and can easily be resiliently deflected outward to disengage from the receptacle terminal thereby enabling easy withdrawal of the receptacle terminal.

9 Claims, 1 Drawing Sheet

ELECTRICAL RECEPTACLE TERMINAL CONNECTOR WITH VISUALLY INSPECTABLE COMPONENTS

BACKGROUND OF THE INVENTION

This invention relates generally to mating male and female insulated electrical connector assemblies wherein a number of pairs of electrical wires are connected together by insertion of one male connector block into a mating female connector block.

Various insulated connector assemblies have been devised for engaging a male terminal with a mating female receptacle. However, in the case of the female receptacle, once the female receptacle terminal is inserted into the connector, internal shoulders within the connector body engage the female receptacle such that either withdrawal of the receptacle from the body or further insertion is prevented. There is no visual means to determine the condition of the internal shoulders except by exerting pulling or pushing force on the wire connected to the female receptacle to determine whether the female receptacle is firmly engaged with the internal shoulders. Excessive pulling force may shear off the retaining shoulder destroying the retaining function of the connector.

In addition, there is no way to visually inspect, repair, or replace the female receptacle terminal without inserting special tools to disengage the internal shoulders from the inserted terminal. Thus, replacement of an individual female receptacle terminal within the connector assembly is often precluded unless special tools are available and used. During troubleshooting and inspection of the electrical circuits of which these single or multi-conductor connectors are a part, it is often desirable to be able to inspect the condition of the female receptacle terminal and the connector assembly as a whole. This ability to visually inspect the components is greatly limited in the prior art connector designs.

SUMMARY OF THE INVENTION

The present invention overcomes the disadvantages of the receptacle terminal connectors presently in use by providing a female receptacle terminal connector insertable within a mating male terminal connector wherein the female receptacle terminals may be extracted from the connector without the use of special tools thus allowing for visual inspection of the female receptacle terminal and the internals of the connector. An example of a suitable female receptacle terminal which may be used in the present invention is more fully described in co-pending U.S. application Ser. No. 916,950 filed 10/8/86, now U.S. Pat. No. 4,713,026, owned by the assignee of this application and is incorporated herein by reference.

The electrical receptacle terminal connector according to this invention includes a hollow body having at least one terminal cavity for receiving each female receptacle terminal. In a preferred embodiment, each connector body has two longitudinal slits in one side wall of the body forming a finger therebetween having an internally projecting shoulder which engages the inserted female receptacle terminal and locks the terminal in place. By pyring the finger outward, away from the body, the shoulder on the finger is disengaged from the female receptacle terminal allowing terminal withdrawal and visual inspection of the connector components. Each hollow receptacle terminal body may be connected together integrally forming a series of individual connectors to form a multiple connector assembly.

When the receptacle terminal connector is mated with the male terminal connector the male terminal connector body surrounds the receptacle connector body thus covering the finger in the sidewall of the receptacle terminal connector. This firmly locks the receptacle in the connector body. Finally, the outer dimensions of the body surrounding the terminal cavity for each female receptacle terminal is tapered from a wider rear end to a narrow forward end so that when mated, the receptacle terminal connector body is firmly wedged within the male terminal connector body.

Further objects, features, and advantages of the invention will become apparent from a consideration of the following description and the appended claims when taken in connection with the accompanying drawings in which:

DETAILED DESCRIPTION OF THE PREFERRED EMBODIMENT

Figure 1:
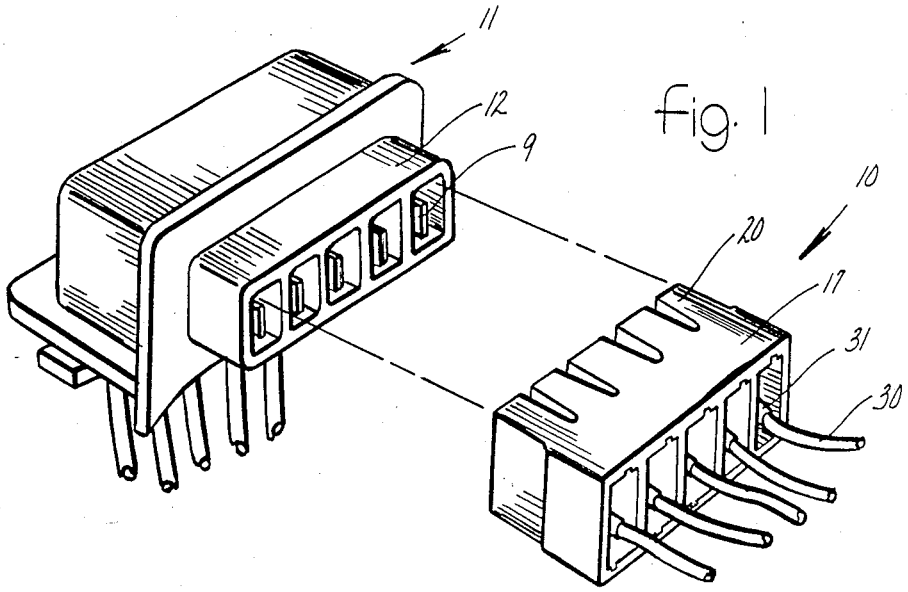
FIG. 1 is a perspective view of the receptacle terminal connector of the present invention shown in assembly relation with a mating male tab terminal connector.

Referring now to FIG. 1, an array of five connectors according to a preferred embodiment of the present invention is shown molded into an integral receptacle terminal connector body 10 to correspondingly mate into a corresponding male tab terminal connector 11. The connector 10 is formed by open hollow generally rectangular body portions 20 connected to an integral connector shroud portion 17. Each insulated wire 30 is connected to an electrical receptacle terminal 31 and inserted within the cavity 15 of rectangular body 20.

Figure 2:
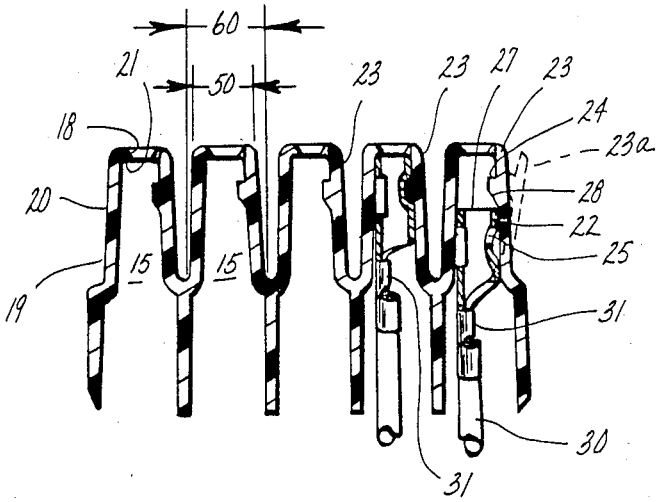
FIG. 2 is a longitudinal sectional view of the receptacle terminal connector shown in FIG. 1, as seen from substantially the line 2—2 in FIG. 4.

The hollow body 20, more clearly shown in the longitudinal sectional view of FIG. 2, includes internally projecting shoulders 21 at the forwardly terminating edge of each side 19 of the cavity 15 of body 20. The inner surface of each shoulder 21 projects inward at right angles to the axis of terminal insertion. The outer surface 18 of the inwardly projecting shoulder 21 is sloped inward to guide the insertion of male tab terminal 9 when connectors 10 and 11 are mated together.

Two receptacle terminals 31 are shown in FIG. 2 for clarity, one fully inserted and one partially inserted. The receptacle terminal 31, insertable within the hollow body 20, has an aperture 25 in the terminal wall 22. As receptacle terminal 31 is inserted, as illustrated by the right hand terminal 31, finger 23 is resiliently pushed outward by contact between the ramp 28 on finger 23 and the forward end 27 of terminal 31 as shown by **23*a*. The receptacle terminal is fully inserted when the forward end 27 of receptacle 31 engages with the shoulders 21 at the terminal end of body 20 and the edge of terminal wall 22 at aperture 25 coacts with and engages the shoulder 24 on the finger 23 as illustrated by the left hand terminal 31 shown in FIG. 2**.

Figure 3:
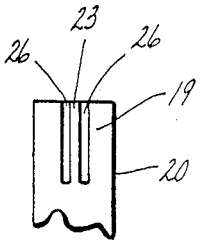
FIG. 3 is a fragmentary side view of the receptacle terminal connector in FIG. 1 showing the finger.

In FIG. 3, a fragmentary side view of the hollow body 20 is shown illustrating the arrangement of finger 23. Finger 23 is formed between two parallel longitudinal slits 26 through one side wall 19 of body 20. Finger 23 is resiliently supported at its base by integral connection with side wall 19. In the preferred embodiment shown, when connectors 10 and 11 are mated, body 20 is inserted within male tab terminal shroud 12 thus covering finger 23. Finger 23 is thereby prevented from inadvertent outward movement ensuring firm engagement of receptacle terminal 31 with body 20.

Firm engagement of connector 10 within connector 11, when the connectors are mated, is provided by the tapered configuration of sidewalls 19 of each hollow rectangular body 20. The outer dimension 60 of body 20 is greatest at the rear portion of body 20 and tapers to a narrower dimension 50 at the forward end of body 20. When connectors 10 and 11 are mated, the hollow bodies 20 become wedged within the male tab terminal shroud 12. Although not shown, shroud 12 may also be oppositely tapered to match the taper of the hollow body 20 to ensure full surface contact between shroud 12 of connector 11 and sidewalls 19 of body 20 when connectors 10 and 11 are mated.

Figure 4:
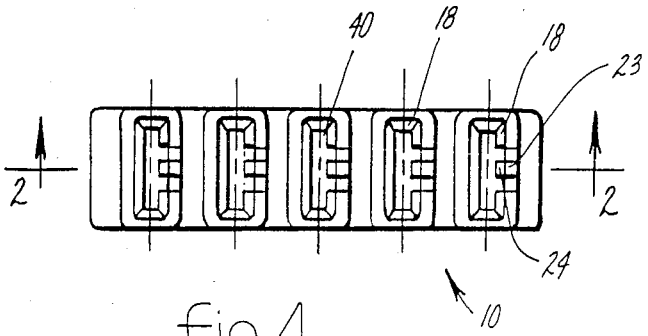
FIG. 4 is a front end view of the receptacle connector shown in FIG. 1.

In FIG. 4, the opening 40 through which the male tab terminal 9 is inserted into cavity 15 is clearly shown. To remove receptacle terminal 31, connectors 10 and 11 must be unmated. Finger 23 is then pulled away from the body 20 as shown by 23*a* in FIG. 2. This disengages the shoulder 24 from aperture 25 on the receptacle terminal 31 allowing withdrawal of the receptacle terminal and visual inspection of the condition of shoulder 24, shoulders 21 on the body 20, and the terminal 31. Shoulder 24 on finger 23 is formed by the smooth ramp projection 28 inward of the sidewall on finger 23. This allows for smooth insertion of receptacle terminal 31 and firm engagement between shoulder 24 and aperture 25.

The instant invention has been described in an illustrative manner and it is to be understood that the terminology which has been used is intended to be in the nature of words of description rather than of limitation.

Obviously many modification and variations of the present invention are possible in light of the above teachings. It is, therefore to be understood that within the scope of the appended claims, the invention may be practiced otherwise than as specifically described.

What is claimed is:

1. An electrical receptacle terminal connector and a mating male terminal connector being movable between engaged and disengaged positions with respect to said receptacle terminal connector, said receptacle terminal connector comprising:

a hollow body having at least one terminal cavity adapted to enclose and support an electrical receptacle terminal member;

said body including at least one wall section defining one wall of said cavity, said cavity wall including a selectively movable portion; and retaining means on said movable portion movable with said portion to a first position for retaining an electrical receptacle terminal member in said cavity, said male terminal connector in said engaged position being in a position with respect to said receptacle terminal connector so as to maintain said movable portion in said first position, said retaining means being movable with said cavity wall movable portion to a second position for releasing said terminal member for withdrawal from said cavity only when said connectors are disengaged.

2. An electrical receptacle terminal connector according to claim 1 wherein said hollow body further includes a forward open end for receiving within a mating male terminal and a rear open end for receiving said receptacle terminal, said rear open end having an outer dimension greater than said forward end and tapering from said rear open end to said forward open end whereby when mated with a corresponding male terminal connector said hollow body is firmly wedged within said corresponding male terminal connector.

3. An electrical receptacle terminal connector according to claim 2 wherein;

said cavity further includes sidewalls, at least one of said side walls of said body terminates in an inwardly raised shoulder which limits insertion of a terminal member to a predetermined fully inserted position in said cavity, and said moveable portion includes a deflectable finger having a retaining shoulder for engaging a terminal fully inserted in said body whereby said terminal is prevented from withdrawal by said shoulder on said finger, said finger being deflectable outwardly to release said terminal for withdrawal and inspection of said body and said terminal.

4. An electrical receptacle terminal connector for mating with a connecting male terminal connector comprising:

a hollow body having at least one interior wall;

a female receptacle terminal insertable within said hollow body;

said hollow body having inwardly projecting first shoulders at one end of said body;

said wall having two longitudinal slits extending from said end having said first shoulders forming a resilient finger between said slits in said wall;

said finger having a raised inner portion forming a second shoulder for engaging said female receptacle terminal when said female receptacle terminal is fully inserted against said first shoulders, said finger engaging said male terminal connector when said connectors are mated whereby said receptacle terminal is restrained from withdrawal or further insertion by said first and second shoulders and said finger can be deflected outward only when said connectors are unmated allowing removal of said receptacle terminal for inspection of said terminal, said hollow body, and said finger.

5. An electrical receptacle terminal connector according to claim 4 wherein said connector further includes a plurality of said hollow bodies integrally connected together.

6. An electrical receptacle terminal connector according to claim 5 wherein said finger has an inclined ramp from said wall to the edge of said second shoulder on said finger.

7. An electrical receptacle terminal connector for mating with a corresponding male terminal connector comprising:

a hollow body having at least one terminal cavity adapted to enclose and support an electrical receptacle terminal member;

said body including at least one wall section defining one wall of said cavity, said cavity wall including a resiliently supported selectively movable portion;

said hollow body further including a forward open end for receiving within a mating male terminal and a rear open end for receiving said receptacle terminal, said rear open end having an outer dimension greater than said forward open end, said forward end insertable within a corresponding male terminal connector; and retaining means on said movable portion movable with said portion to a first position for retaining an electrical receptacle terminal member and movable to a second position for releasing said terminal member for withdrawal from said cavity, said retaining means being maintained in said first position by said corresponding male terminal connector preventing release of said electrical receptacle terminal member from said hollow body when said terminal connector is mated with said corresponding male terminal connector.

8. An electrical receptacle terminal connector comprising:

a hollow body having at least one terminal cavity adapted to enclose and support an electrical receptacle terminal member;

said body including at least one wall section defining one wall of said cavity, said cavity wall including a selectively movable portion; and retaining means on said movable portion movable with said portion to a first position for retaining an electrical receptacle terminal member and movable to a second position for releasing said terminal member for withdrawal from said cavity, said hollow body further including a forward open end for receiving within a mating male terminal and a rear open end for receiving said receptacle terminal, said rear open end having an outer dimension greater than said forward end and tapering from said rear open end to said forward open end whereby when mated with a corresponding male terminal connector said hollow body is firmly wedged within said corresponding male terminal connector.

9. An electrical receptacle terminal connector according to claim 8 wherein:

said cavity further includes side walls;

at least one of said side walls of said body terminating in an inwardly raised shoulder that limits insertion of a terminal member to a predetermined fully inserted position in said cavity, and said movable portion includes a deflectable finger having a retaining shoulder for engaging said terminal member fully inserted in said body whereby said terminal member is prevented from withdrawal by said shoulder on said finger, said finger being deflectable outwardly to release said terminal member for withdrawal and inspection of said body and said terminal member.

* * * * *